United States Patent [19]

Schoop

[11] 4,018,017

[45] Apr. 19, 1977

[54] EXPANSION JOINT MEANS

[76] Inventor: Traugott K. Schoop, Mellinger Strass 48, 5401 Baden, Switzerland

[22] Filed: Apr. 23, 1975

[21] Appl. No.: 570,963

[30] Foreign Application Priority Data

| | | |
|---|---|---|
| Apr. 25, 1974 | Germany | 7414474[U] |
| June 19, 1974 | Germany | 2429430 |
| Mar. 21, 1975 | Germany | 2512655 |

[52] U.S. Cl. ..... 52/58; 52/468; 52/573

[51] Int. Cl.[2] ..... E04D 1/35

[58] Field of Search ..... 52/466–469, 52/396, 403, 573, 58, 62, 470, 471; 404/67, 74

[56] References Cited

UNITED STATES PATENTS

| | | | |
|---|---|---|---|
| 3,643,388 | 2/1972 | Parr et al. | 52/58 |
| 3,814,530 | 6/1974 | Neff | 404/67 |
| 3,862,810 | 1/1975 | Welch | 52/396 X |

FOREIGN PATENTS OR APPLICATIONS

| | | | |
|---|---|---|---|
| 1,103,501 | 2/1968 | United Kingdom | 52/573 |

*Primary Examiner*—Price C. Faw, Jr.
*Assistant Examiner*—Carl D. Friedman
*Attorney, Agent, or Firm*—Cushman, Darby & Cushman

[57] ABSTRACT

Expansion joint means for bridging structural joints in a flat roof that is to be covered with a roofing material such as roofing felt the means being in the form of a strip and having a stretchable central portion and integrally formed parallel side portions of elastically flexible material such as synthetic rubber.

17 Claims, 10 Drawing Figures

Fig. 9
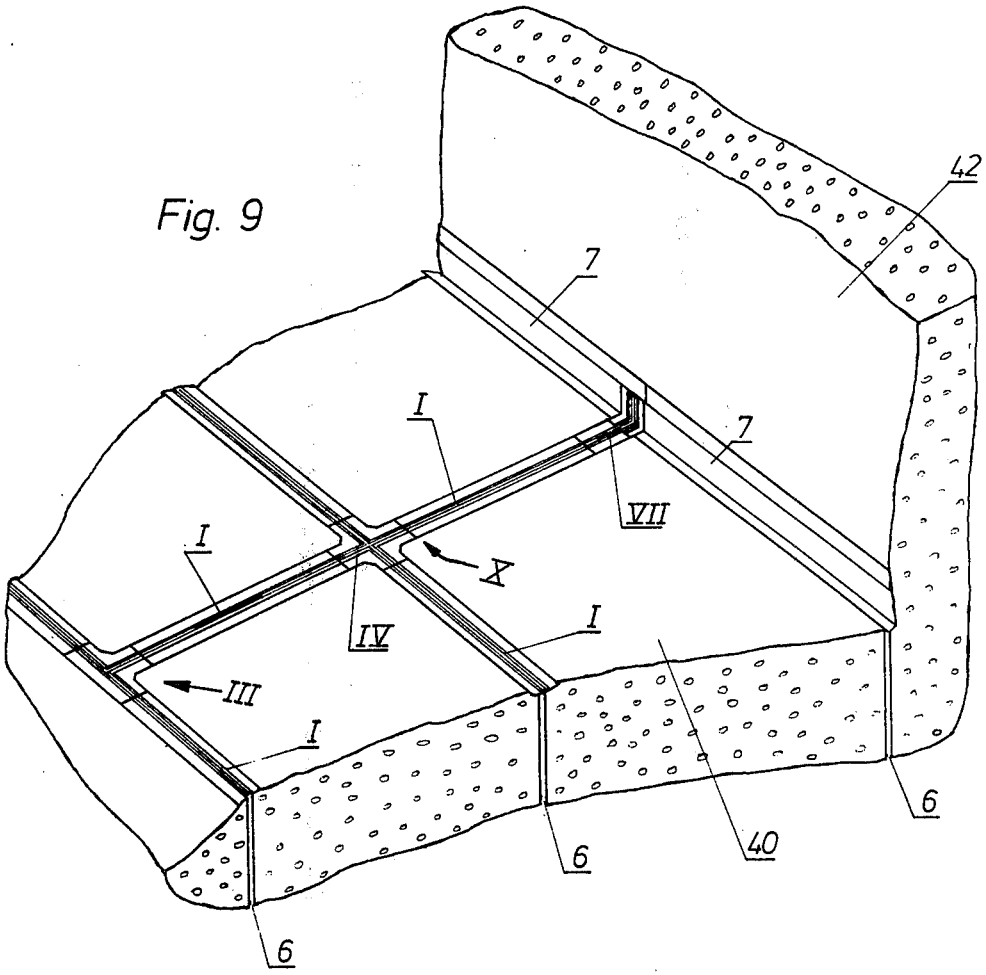
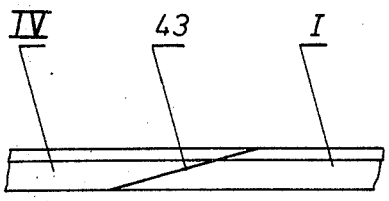
Fig. 10

EXPANSION JOINT MEANS

The present invention relates to expansion joint means for bridging structural joints on a flat roof that is required to be covered with a roofing material such as roofing felt, which is a bituminous type material, the means being in the form of a strip, angle, Tee, cross, or the like and having substantially unstretchable parallel side portions connected by a stretchable centre portion. The side portions of such expansion joint means are connected to the roofing material principally by adhesive bonding. The stretchable centre portion bridges the actual joint and absorbs movement due to expansion and contraction of the joint.

Figure 3:
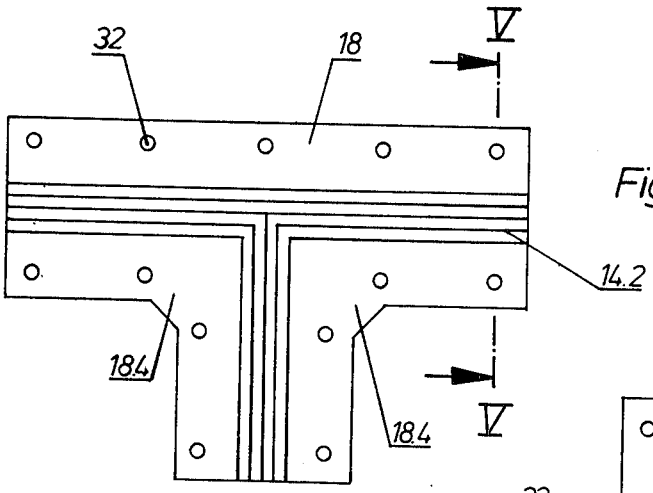

Such an expansion joint means has been proposed in the specification of German Petty Pat. No. 7044967 where it is illustrated in FIG. 3. The side portions of this means are made of sheet metal and they are bonded by vulcanisation to a centre portion made of an elastic material such as synthetic rubber.

If it is desired to join together two straight lengths of means of this kind, each being say 6 meters in length, then the ends must be cut off in such a way that the metal side portions project a short distance beyond the ends of the synthetic rubber centre portions. The sheet metal side portions are then overlapped and joined by soldering, whereas the centre portions are butted end-to-end and connected together with an adhesive or by vulcanisation.

Both operations call for extreme cleanliness. The sheet metal side portions must be cleaned in two different operations with two different primers to prepare them for soldering. During soldering care must be taken to ensure that the synthetic rubber portions must each be individually cleaned and then joined with the help of an ahesive or by vulcanisation.

These operations are complicated, time-consuming, and particularly difficult to perform on a roof, where clean surfaces are liable to be fouled by smoke and dust.

It has therefore been the usual practice to avoid connecting different lengths of means of the specified kind by soldering and adhesive bonding or vulcanisation and instead to bend about 20 cms of the end of each length vertically upwards and to connect the adjacent upturned ends by pushing a water-tight metal box over them from above. A large flat roof may contain a structural joint at intervals of 7 meters in both the longitudinal and transverse directions. At each intersection of these joints such a box must then be fitted for the purpose of connecting the ends of the four lengths which come together at these points. Flat roofs studded with boxes are clearly not suitable surfaces for walking or for vehicles.

The present invention provides expansion joint means for bridging structural joints in a flat roof that is to be covered with roofing material, the means is one embodiment being in the form of a strip and comprising substantially unstretchable parallel longitudinal side portions connected by a stretchable centre portion, the side portions and the centre portion being integrally formed and the centre portion being of less thickness than the side portions.

Preferably the side portions and centre portion are formed integrally from synthetic rubber material.

the centre portion may have longitudinally extending grooves therein.

The central portion of the means is generally thinner than the side portions. If the centre portion is provided with longitudinal grooves, then the centre portion should be thinner than the side portions at least where these grooves are located and preferably also overall including the lands or ribs between the grooves.

When lengths of the expansion joint means of the present invention are laid on a roof the complications involved in cleaning and soldering sheet metal side portions are eliminated because the means lacks sheet metal side portions. Care must merely be taken to ensure that the parts that are to be adhesively bonded or vulcanised are completely clean.

Since in production vulcanisation bonding of a rubber centre portion to sheet metal side portions is also eliminated, the proposed expansion joint means is less expensive to make. As the entire means consists of elastic material it can be rolled up in rolls like a tape and any desired length can be transported to the site, the maximum length being limited merely by considerations of weight. When the known means with sheet metal side portions is rolled up there is always a risk that bends or kinks may remain which must be removed on the site with a good deal of extra trouble and work so that in practice straight lengths exceeding 6 meters have not been used.

The conventional expansion joint means above described is produced by vulcanising the synthetic rubber centre portion to the sheet metal side portions. It is always possible that impurities on the sheet metal prior to vulcanisation, for instance due to finger marks, grease or dust, may result in the creation of a locally badly sealing vulcanised bond. In the expansion joint means of the present invention this is out of the question because the entire means consists of elastic material and there is no vulcanised rubber-to-metal bond.

In order to bridge structural joints which intersect or meet at an angle, means according to the present invention may be provided wherein said centre portion and at least one of said side portions comprise integral sections which are angled with respect to one another. Thus the means may be in the form of an angle, a Tee or a cross.

Means in the form of a cross may be provided for oblique as well as orthogonal joint intersections.

For the purpose of sealing joints between the ends of metal roof flashings, the previously mentioned specification of German Pat. No. 7044967, in FIG. 1, proposes to use means in the form of a joint sealing strip one end of which extends widthwise between the ends of the flashings, the intention being to absorb relative movement of the ends of the flashings due to thermal expansion and contraction. The side portions of the strip, which extend outwardly of the flashings, perform relative angular movements during expansion and contraction of the flashings which can be related to a centre of rotation where the translatory movement is nil. The sealing strip ensures that the joints in the covering of the roof at this point remain watertight. The joint sealing strip also prevents the roofing felt used as a covering material from working loose or tearing away at such a joint.

In the joint sealing strip hitherto used the flat side portions on each side of a flexibly stretchable centre portion consist of sheet metal.

With this form of construction the sheet metal side portions tend to wrinkle or buckle when the ends thereof connected to the flashings move to and fro during expansion and contraction of the flashings.

According to a further feature thereof, the present invention provides means for use in connecting the ends of metal roof flashings, in the form of a strip of predetermined length, the side portions at one end of the strip being of sheet metal and the remainders of the side portions being of elastically flexible material, the centre portion terminating short of the other end of the strip and the side portions at said other end of the strip being connected by a bridging portion, whereby in use the metal side portions at said one end of the strip can be attached to the ends of the metal flashings with the centre portion between the ends of the metal flashings and the remainder of the strip extending outwardly from the metal flashings substantially to a centre of zero motion in the region of which the side portions at said other end of the strip are connected by said bridging portion.

Preferably the centre portion and the remainders of the side portions of the strip are formed from synthetic rubber material and the metal side portions at said one end of the strip are attached by vulcanisation to the centre portion and to the remainders of the side portions.

Advantageously, the centre portion and the remainders of the side portions overlap and tightly embrace adjacent side margins of the sheet metal side portions at said one end of the strip.

Thus, that part of each side portion which is attached to an end of a flashing consists of metal, but the remainder of the side portion is made of elastic material, e.g., synthetic rubber. The elastic parts of the side portions can absorb distortion due to expansion and compression without buckling and throwing.

Although in such an arrangement the stretchable centre portion must be bonded as by vulcanisation to end side portions made of metal, the vulcanised rubber-to-metal bond is confined to a very short seam so that the risk of the joint not being tight because of dirty edges prior to vulcanisation is very much less.

According to the shape of the flashings that are to be connected by the means, it will often be necessary for the latter to be bent over at angles of up to 180°. This gives rise to the problem of finding space for the accommodation of the material of the centre portion which is several times thicker than the sheet metal end side portions. If in the least favourable circumstances the strip must be folded so that the side formed with the grooves and ribs or lands is on the inside, i.e. facing the inside of the included angle, then the material forming the lands or ribs can squeeze into the grooves. This enables the strip to be folded over at very acute reentrant angles and to form a sharp fold. Moreover, the material along the margins of the centre portion, namely the material that is bonded to the metal, can also be partly squeezed into the adjacent groove to permit a sharp folding edge to be formed. The same also applies when the means is folded around a salient angle, i.e. so that the grooves and lands or ribs are on the outside of the angle. The ribs or lands will then widen by being subjected to tension and pull into the neighbouring grooves.

Figure 2:
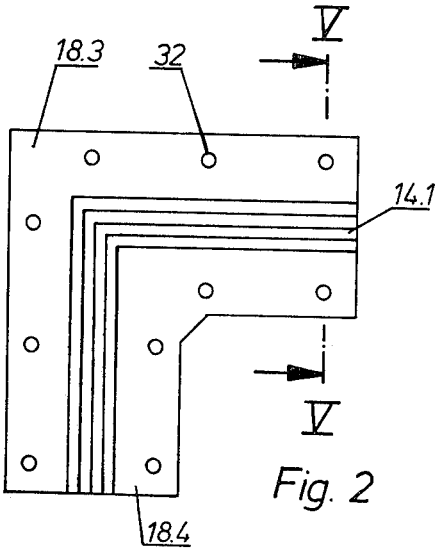
Figure 1:
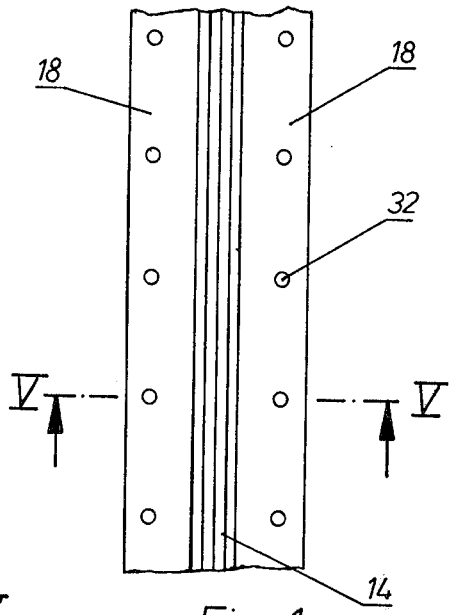
Figure 4:
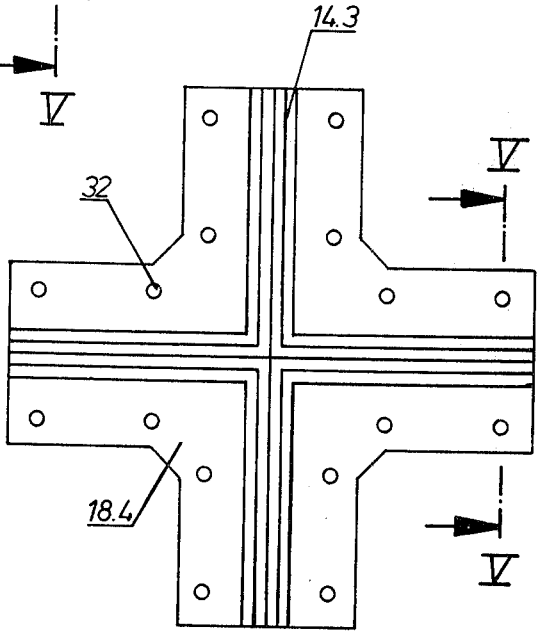
Figure 7:
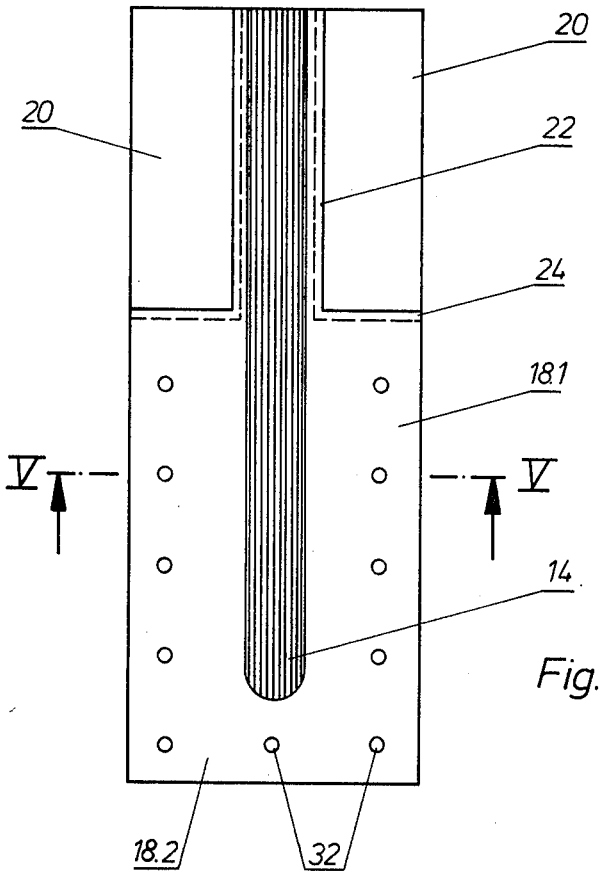
Figure 5:
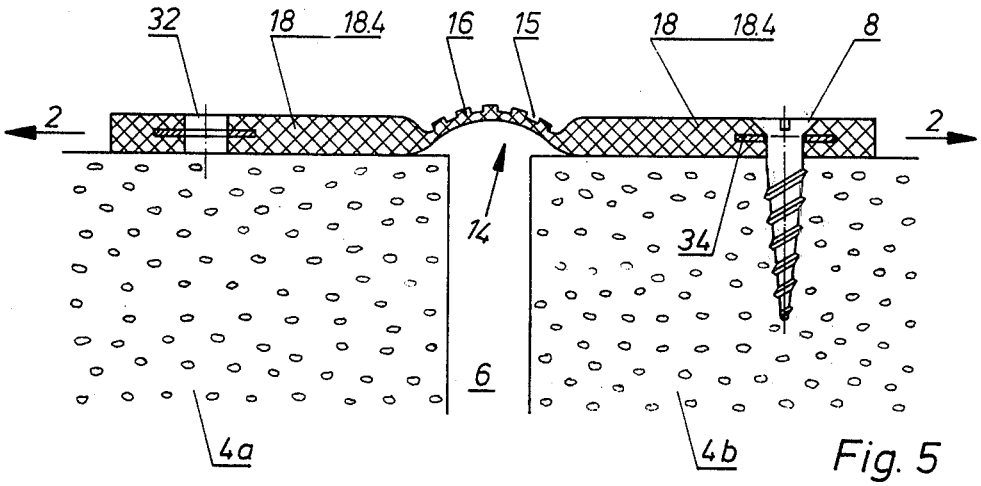
Figure 8:
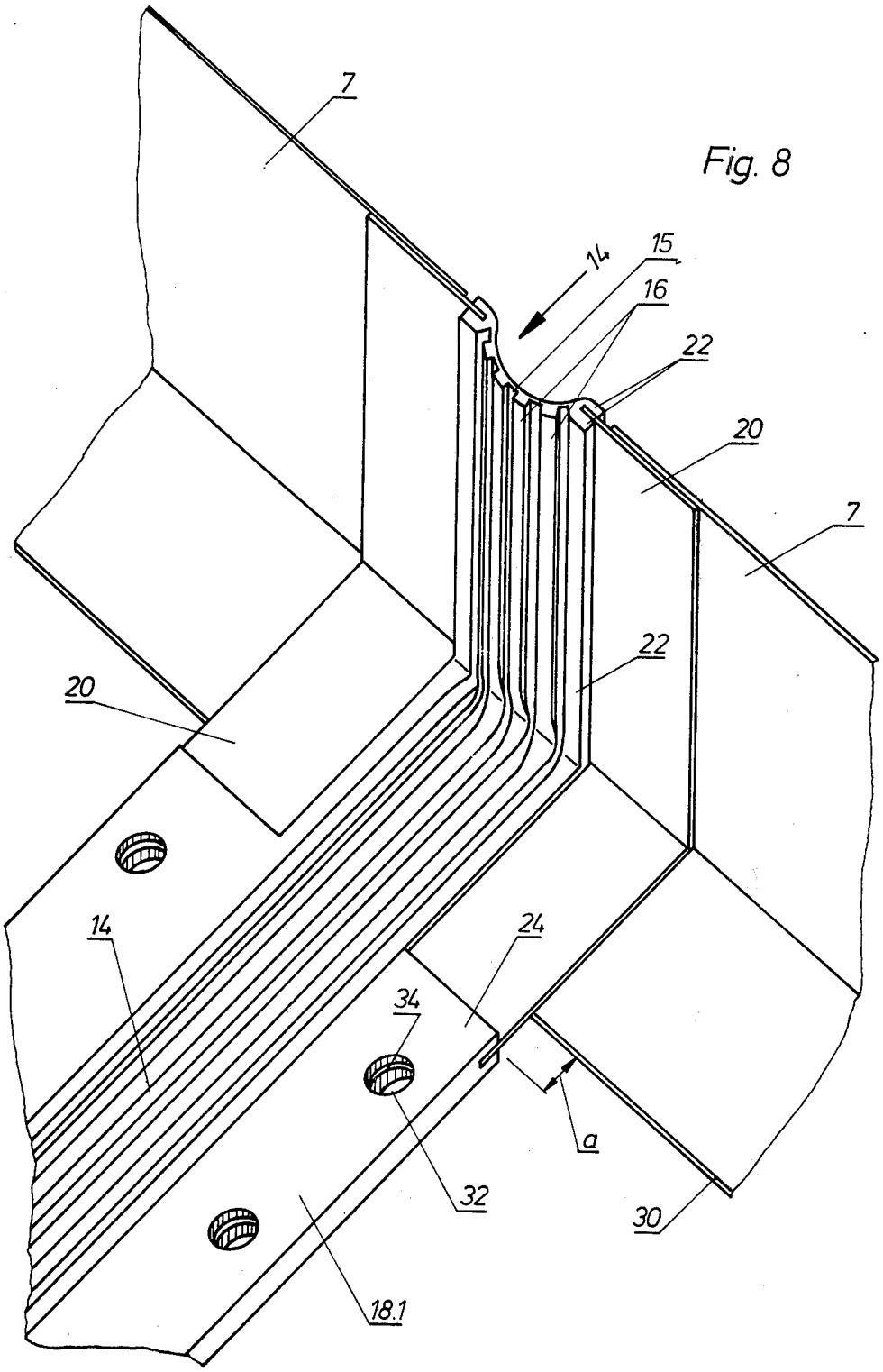

Embodiments of the invention will now be described with reference to the accompanying drawings, in which:

FIG. 1 is a view in plan of means according to the invention in the form of a straight joint sealing strip, FIGS. 2, 3 and 4 are views in plan of special connecting pieces according to the invention, more particularly an angle piece, a Tee-piece and a cross piece, FIG. 5 is a cross section taken on the line V—V in FIGS. 1 to 4 and 7, FIG. 6 is a view in plan of the edge portion of a special joint sealing strip of a kind already known in the art bonded to the adjacent ends of two flashings, FIG. 7 is a special joint sealing strip according to the invention, FIG. 8 is a perspective view of the manner in which a special sealing strip according to FIG. 7 is attached to the adjacent angular ends of a flashing, FIG. 9 is a perspective view of the disposition of different types of means according to the invention in use on a roof, and FIG. 10 is a sectional side elevation of a butt joint between the ends of two lengths of sealing strip, the section being taken in the direction of arrow X in FIG. 9.

For the sake of greater clarity the centre portions in the embodiments in FIGS. 1 to 4, 7 and 9 are shown to contain fewer longitudinal ribs than would in practice be provided.

In conjunction with the cross section in FIG. 5, the view in plan in FIG. 1 of a sealing strip according to the invention shows that the strip comprises side portions 18 made of synthetic rubber and a centre portion 14 which is thinner than the side portions. The centre portion may be convexly arched and it may be formed with lands or ribs 16 and grooves 15 but, even inclusive of the ribs, the thickness is still less than that of the side portions. If the sealing strip is subjected to transverse pull acting in the direction indicated by arrows 2 in FIG. 5, then the centre portion 14 will first be pulled flat and then stretched. Thrust in the direction contrary to that indicated by the arrows 2 will result in the previously stretched centre portion contracting and then arching convexly upwards. This action permits relative movement of the two structural components 4*a* and 4*b* on either side of a joint 6 to be absorbed.

The side portions contain fixing holes 32 which are each reinforced by the embedment in the side portions by vulcanisation of annular discs 34 resembling washers. The side portions can be fastened to a concrete slab, for instance by means of screws 8, such as the single screw illustrated.

For bridging an angle in a joint a special anglepiece according to FIG. 2 can be used. In this example the side portions 18.3 and 18.4 as well as the centre portion 14.1 meet at an angle.

The sealing T-piece in FIG. 3 serves for bridging a T-junction between joints. The T-piece contains one straight side portion 18 and two angled side portions 18.4 as well as a T-shaped centre portion 14.2.

The sealing cross-piece in FIG. 4 contains four angled side portions 18.4 and a centre portion 14.3 forming a cross.

The sealing strip pieces according to FIGS. 2 to 5 have cross sections identical with that shown in FIG. 5 (cf. the section lines V—V). If structural joints should meet at angles other than right angles, then sealing strip pieces will be produced analogous to those in FIGS. 2 to 4 except that the angles are other than right angles.

Figure 6:
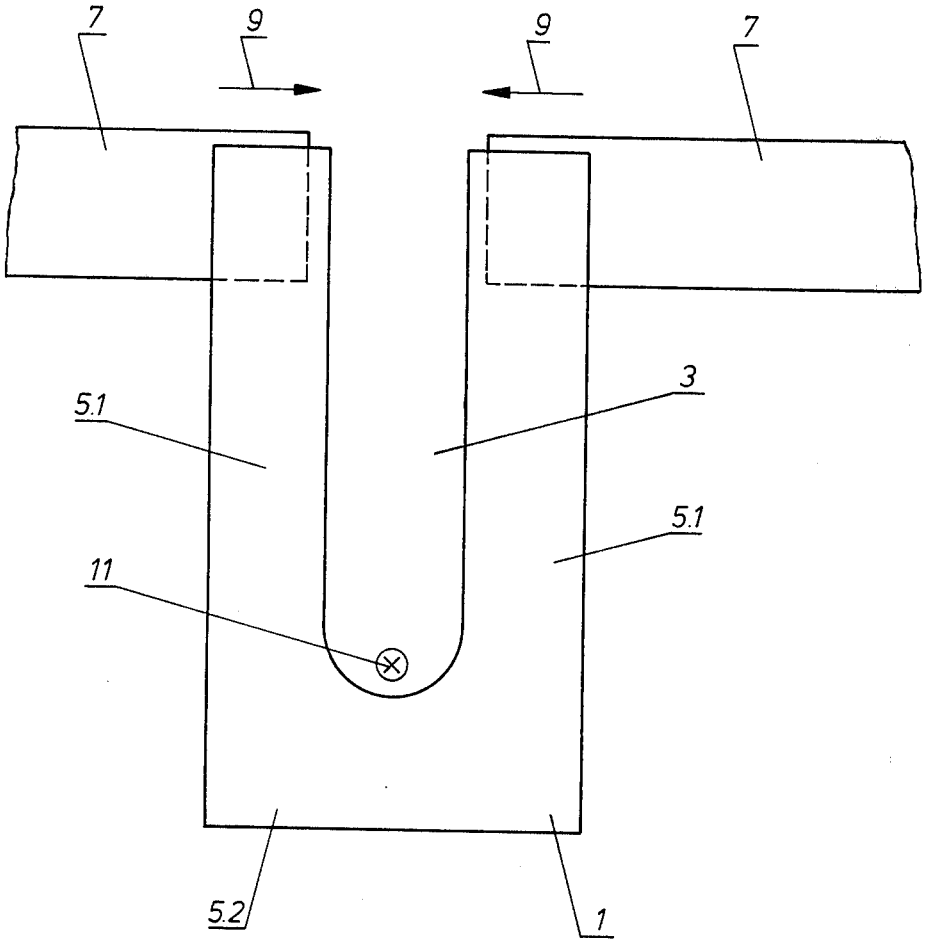

FIG. 6 is a schematic representation of an arrangement according to FIG. 1 in the specification of German Petty Pat. No. 7044967. In that arrangement a sheet metal plate 1 is provided with a longitudinal slot 3 which extends from one end of the plate along the greater part of its length. Flat side portions 5.1 thus remain which are connected at one of their ends by a transverse web 5.2.

At the top of FIG. 7, flashings 7 are connected to the ends of the side portions 5.1. Relative motion between the flashings 7 for instance in the direction indicated by arrows 9, is reduced along the length of the joint sealing strip until at a point roughly at 11 there is no movement at all.

If the relative displacement of the flashings 7 were as indicated by the arrows 9, then the sheet metal of the web 5.2. would necessarily have to stretch. As this is not possible to a sufficient extent the side portions 5.1 tend to buckle and throw. Conversely if the displacement is contrary to the direction indicated by the arrows 9 then the sheet metal which forms the web 5.2 will tend to buckle. Buckling of the sheet metal is undesirable because in course of time the sheets covering the roof and adhesively bonded to the side portions of the strip will be damaged.

In the arrangement according to the invention, as shown in FIGS. 7 and 8, only short metal side portions 20 are provided, namely only in that region which must be attached to the ends of the flashings, whereas the remainder of the side portions 18.1 and 18.2 consist of synthetic rubber. This synthetic rubber is capable of satisfactorily absorbing elongation and compression without buckling.

The arrangement of FIG. 7, when seen in the section shown in FIG. 5, is identical with that of the arrangements according to FIGS. 1 to 4. However, the centre portion 14 in FIG. 7 does not continue to the bottom end of the strip. The margins of the two sheet metal side portions 20 are overlapped and embraced by twin flanges 22 and 24 of the synthetic rubber centre portions 14 and of the side portions 18.1. The sheet metal and the synthetic rubber are tightly and firmly bonded by vulcanisation. When the piece of strip is bent over, some of the material of the two flanges 22 can enter the neighbouring grooves 15.

FIG. 8 is a perspective view of the junction with the two end portions of a simple angle flashing 7. The length of the sheet metal side portions 20 is selected to match the width of the flashing in question so that only the sheet metal side portions come into contact with the flashing. Sheet metal side portions 20 and flashings 7 are joined by welding, soldering or in some other way. Repeated bending enables the joint sealing strip to be fitted to complicated mouldings.

The sheet metal side portions 20 are so chosen that they project a short distance *a* (FIG. 8) of a few centimeters beyond the edge 30 of the flashing to ensure that the synthetic rubber will not be scorched when the parts 7 and 20 are soldered or welded together.

FIG. 9 is an illustration of an application. On a flat roof 40 of which only part is seen, and which adjoins a vertical wall 42, sheet metal flashings 7 are provided. The flashings are interconnected by special pieces VII the outer ends of which resemble that of FIG. 8. The structural joint which extends further to the left is covered with a joint sealing strip I according to FIG. 1. This ends at a cross piece IV according to FIG. 4. From the cross piece joint sealing strips I run in all three directions. At the left hand end the strip is connected to a T-piece III according to FIG. 3 which is connected to sealing strips I in three directions. The junctions may be cut to form splayed heading joints, as shown in FIG. 10. FIG. 10 shows the junction X in FIG. 9 between the sealing strip I and the cross piece IV. The ends of these two parts are cut obliquely in the plane marked 43. These oblique faces are bonded by means of an adhesive or by cold vulcanisation. The sealing strips I are unwound from rolls at the site and cut to length. Straight lengths of sealing strip need not as a rule be joined together unless it is desired for economy to use offcuts.

Angle pieces according to FIG. 2 are incorporated in the manner indicated in FIG. 9.

When the sealing strips have been laid lengths of roofing material such as plastics sheeting or roofing felt are adhesively attached to the side portions of the strips. The roof is thus provided with a skin of overall tightness. The roof is completed by a rendering of loose sand or gravel, or paving slabs may be laid on the sand to form a surface for walking and/or for vehicles.

Especially good results are achieved with an expansion joint of which the longitudinal side portions are made of a practically unstretchable material. Only the centre portion is of stretchable material. In making the expansion joints, different kinds of artificial rubber mixtures can be used for side portions and centre portion in order to achieve the different stretching characteristics.

What I claim is:

1. The improvement in expansion joint means in combination with a flat roof and bituminous type roofing material, said combination comprising:

a flat roof having at least one structural joint formed by adjacent structural components, expansion joint means for bridging said joint and including a centre portion made solely of stretchable synthetic rubber and two parallel side portions integrally connected respectively on opposite longitudinal sides of said centre portion and being made of substantially unstretchable material including synthetic rubber, the centre portion being of less thickness than said side portions, means securing said side portions respectively to said adjacent structural components with said centre portion over said joint, and roofing material of the bituminous type secured on top of said structural components and being bonded to said synthetic rubber of said side portions.

2. The combination as in claim 1 wherein said centre portion has longitudinally extending grooves therein.

3. The combination as in claim 1 wherein said structural joint and expansion joint means are in the form of a strip.

4. The combination as in claim 1 wherein said joint and expansion joint means are in the form of an angle.

5. The combination as in claim 1 wherein said joint and expansion joint means are in the form of a Tee.

6. The combination as in claim 1 wherein said joint and expansion joint means are in the form of a cross.

7. The combination as in claim 1 wherein said structural components are metal flashings, and wherein said expansion joint means is in the form of a strip of predetermined length, said side portions having one end shorter than said predetermined length and having respective sheet metal strips connected to the said shorter ends of said side portions and extending along and connected to opposite edges of said centre portion to complete the predetermined length of said strip, said sheet metal strips being attached to the ends of the metal flashings.

8. The combination according to claim 7 wherein the centre portion terminates short of the other end of the predetermined length strip and the side portions at said other end are connected by a bridging portion, said centre portion extending between said sheet metal strips and then between said side portions to substantially a centre of zero motion in the region of which said bridging portion connects said side portions.

9. The combination according to claim 8 wherein the metal strips at said one end are attached by vulcanisation to the centre portion and to the side portions.

10. The combination according to claim 8 wherein the centre portion and the side portions overlap and tightly embrace adjacent side margins of the sheet metal strips at said one end.

11. The combination according to claim 1 for use in bridging structural joints at points where these cross or abut at an angle, wherein said centre portion and at least one of said side portions comprise integral sections which are angled with respect to one another.

12. The combination to claim 1, wherein fixing holes are provided in the side portions.

13. The combination according to claim 12 wherein the fixing holes are reinforced by annular discs embedded in the side portions.

14. Expansion joint means for bridging structural joints in a flat roof that is to be covered with a bituminous type roofing material, comprising:

a stretchable centre portion and substantially unstretchable parallel longitudinal side portions connected by said stretchable centre portion, the side portions and the centre portion being integrally formed with the centre portion being made solely of stretchable synthetic rubber material, said side portions being made of substantially unstretchable material including synthetic rubber means for making the side portions bondable to said bituminous type roofing material, the said centre portion being of less thickness than the side portions, said means being for use in connecting the ends of metal roof flashings and being in the form of a strip of predetermined length, and said side portions of synthetic rubber material having one end shorter than said predetermined length and having respective sheet metal strips connected to the said shorter ends of said side portions and extending along and connected to opposite edges of said centre portion to complete the predetermined length of said strip whereby in use the sheet metal strips can be attached to the ends of the metal flashings.

15. Means according to claim 14 wherein the centre portion terminates short of the other end of the predetermined length strip and the side portions at said other end are connected by a bridging portion, said centre portion extending between said sheet metal strips and then between said side portions to substantially a centre of zero motion in the region of which said bridging portion connects said side portions.

16. Means according to claim 14 wherein the side portions of the strip are formed from synthetic rubber material and wherein the metal strips at said one end are attached by vulcanisation to the centre portion and to the side portions.

17. Means according to claim 14 wherein the centre portion and the side portions overlap and tightly embrace adjacent side margins of the sheet metal strips at said one end.

* * * * *